US007856737B2

(12) United States Patent
McMahon, Jr. et al.

(10) Patent No.: US 7,856,737 B2
(45) Date of Patent: Dec. 28, 2010

(54) APPARATUS AND METHOD FOR REDUCING A MOISTURE CONTENT OF AN AGRICULTURAL PRODUCT

(75) Inventors: Robert James McMahon, Jr., Bull Valley, IL (US); Kenneth William Kroeker, St. Charles, IL (US)

(73) Assignee: Mathews Company, Crystal Lake, IL (US)

( * ) Notice: Subject to any disclaimer, the term of this patent is extended or adjusted under 35 U.S.C. 154(b) by 506 days.

(21) Appl. No.: 11/897,008

(22) Filed: Aug. 28, 2007

(65) Prior Publication Data

US 2009/0056162 A1 Mar. 5, 2009

(51) Int. Cl.
*F26B 21/08* (2006.01)

(52) U.S. Cl. ..... 34/511; 34/573; 34/575; 48/61; 239/69.63; 392/486; 110/187; 219/121.63; 714/6; 714/14

(58) Field of Classification Search ..... 34/511, 34/573, 575; 714/6, 14; 110/187; 432/254; 392/486; 239/69.63; 48/61; 700/166, 271; 219/121.63; 454/180
See application file for complete search history.

(56) References Cited

U.S. PATENT DOCUMENTS 2,882,910 A * 4/1959 Jones et al. ..... 131/303
2,885,789 A * 5/1959 Conkling et al. ..... 34/547
2,935,009 A * 5/1960 Cloud et al. ..... 454/180
3,032,986 A * 5/1962 Wright ..... 60/39.281
3,280,474 A * 10/1966 Van Doorn et al. ..... 34/497
3,337,907 A * 8/1967 Williams ..... 425/148
3,392,424 A * 7/1968 Mangialardi, Jr. et al. . 19/66 CC
3,427,820 A * 2/1969 Hart ..... 62/307
3,547,775 A * 12/1970 Bossen et al. ..... 162/198
3,601,373 A * 8/1971 Hartley ..... 366/17
3,721,014 A * 3/1973 Voelskow ..... 34/371
3,788,125 A * 1/1974 Kirschstein et al. ..... 73/32 R
3,802,020 A * 4/1974 Stone et al. ..... 15/4
3,905,126 A * 9/1975 Villalobos et al. ..... 34/72
4,149,529 A * 4/1979 Copeland et al. ..... 601/17
4,224,863 A * 9/1980 Barber et al. ..... 99/331
4,452,152 A * 6/1984 John et al. ..... 110/235
4,473,013 A * 9/1984 John et al. ..... 110/235
4,474,582 A * 10/1984 Dille et al. ..... 48/61
4,483,258 A * 11/1984 John et al. ..... 110/235
4,492,843 A * 1/1985 Miller et al. ..... 219/121.63
4,501,949 A * 2/1985 Antol et al. ..... 219/121.63
4,541,055 A * 9/1985 Wolfe et al. ..... 700/166
4,543,819 A * 10/1985 Chin et al. ..... 137/88
4,545,018 A * 10/1985 Clements et al. ..... 700/166
4,547,855 A * 10/1985 Lanyi et al. ..... 700/166

(Continued)

FOREIGN PATENT DOCUMENTS

JP 01230979 A * 9/1989

*Primary Examiner*—Stephen M. Gravini
(74) *Attorney, Agent, or Firm*—Pauley Petersen & Erickson

(57) ABSTRACT

This invention relates to an apparatus and a method that reduces a moisture content of an agricultural product, particularly by using moisture sensors and/or temperature sensors. The apparatus includes at least one moisture sensor, optionally at least one temperature sensor, a controller, a flow regulator and/or a dryer. The method includes obtaining a moisture content and a temperature to calculate a product flowrate and optionally an energy input. A product flowrate signal is used to vary the flow regulator and an energy input signal is used to vary the energy regulator.

12 Claims, 5 Drawing Sheets

U.S. PATENT DOCUMENTS 4,553,024 A * 11/1985 Findlay ..... 392/503
4,560,856 A * 12/1985 Miller et al. ..... 219/121.63
4,572,218 A * 2/1986 Hine et al. ..... 131/302
4,627,568 A * 12/1986 Lortie et al. ..... 236/44 B
4,718,020 A * 1/1988 Duich et al. ..... 700/271
4,721,448 A * 1/1988 Irish et al. ..... 425/144
4,730,772 A * 3/1988 Lortie et al. ..... 236/44 R
4,808,377 A * 2/1989 Childers et al. ..... 422/26
4,898,092 A 2/1990 Greer
4,909,988 A * 3/1990 Childers et al. ..... 422/26
4,993,316 A 2/1991 Greer
4,994,286 A 2/1991 Greer
5,000,624 A * 3/1991 Steiger ..... 406/124
5,029,458 A * 7/1991 Obata et al. ..... 68/19.2
5,067,968 A * 11/1991 Davidson et al. ..... 44/550
5,099,654 A * 3/1992 Baruschke et al. ..... 62/180
5,113,770 A * 5/1992 Godbe et al. ..... 110/187
5,124,942 A * 6/1992 Nielsen et al. ..... 715/713
5,173,855 A * 12/1992 Nielsen et al. ..... 700/284
5,182,871 A * 2/1993 Karls ..... 34/485
5,187,797 A * 2/1993 Nielsen et al. ..... 715/708
5,194,275 A 3/1993 Greer
5,229,649 A * 7/1993 Nielsen et al. ..... 307/31
5,232,511 A * 8/1993 Bergman ..... 134/2
5,235,995 A * 8/1993 Bergman et al. ..... 134/105
5,239,456 A * 8/1993 Badavas et al. ..... 700/34
5,251,153 A * 10/1993 Nielsen et al. ..... 700/284
5,273,905 A * 12/1993 Muller et al. ..... 435/286.5
5,290,359 A * 3/1994 Coonen et al. ..... 118/712
5,357,991 A * 10/1994 Bergman et al. ..... 134/102.1
5,370,741 A * 12/1994 Bergman ..... 134/3
5,377,708 A * 1/1995 Bergman et al. ..... 134/105
5,391,080 A * 2/1995 Bernacki et al. ..... 434/254
5,437,882 A 8/1995 Greer et al.
5,442,995 A 8/1995 Greer
5,445,176 A * 8/1995 Goff ..... 137/80
5,500,081 A * 3/1996 Bergman ..... 438/706
5,616,851 A * 4/1997 McMahon et al. ..... 73/29.01
5,628,260 A * 5/1997 Rongved ..... 110/245
5,634,281 A * 6/1997 Nugent ..... 34/207
5,637,340 A 6/1997 Greer
5,661,349 A * 8/1997 Luck ..... 307/151
5,741,711 A * 4/1998 Amirav et al. ..... 436/154
5,763,858 A * 6/1998 Jones ..... 219/506
6,123,093 A * 9/2000 D'Antonio et al. ..... 137/78.3
6,159,442 A * 12/2000 Thumm et al. ..... 423/659
6,192,750 B1 2/2001 Greer et al.
6,221,332 B1 * 4/2001 Thumm et al. ..... 423/659
6,237,283 B1 * 5/2001 Nalbandian et al. ..... 47/48.5
6,246,831 B1 * 6/2001 Seitz et al. ..... 392/486
6,249,130 B1 6/2001 Greer
6,354,922 B1 * 3/2002 Sakurai et al. ..... 451/67
6,358,128 B1 * 3/2002 Sakurai et al. ..... 451/67
6,388,453 B1 5/2002 Greer
6,390,378 B1 * 5/2002 Briscoe et al. ..... 236/44 C
6,493,086 B1 * 12/2002 McAndrew et al. ..... 356/437
6,508,078 B2 * 1/2003 Sower ..... 62/532
6,508,920 B1 * 1/2003 Ritzdorf et al. ..... 204/194
6,540,509 B2 * 4/2003 Asano et al. ..... 432/205
6,571,641 B1 6/2003 LaBorde
6,682,408 B2 * 1/2004 Sakurai et al. ..... 451/67
6,700,394 B2 3/2004 Greer
6,711,961 B2 * 3/2004 Theriault et al. ..... 73/865.6
6,820,439 B1 * 11/2004 Marek ..... 62/259.4
6,834,511 B2 * 12/2004 Hatakeyama ..... 62/173
6,849,239 B2 * 2/2005 Morris ..... 422/98
6,856,444 B2 2/2005 Ingalls et al.
6,863,732 B2 * 3/2005 Asano et al. ..... 118/715
6,878,044 B2 * 4/2005 Sakurai et al. ..... 451/67
6,905,645 B2 * 6/2005 Iskra ..... 264/128
6,960,476 B2 * 11/2005 Morris ..... 436/149
6,986,654 B2 * 1/2006 Imiolek et al. ..... 425/182
6,987,246 B2 * 1/2006 Hansen et al. ..... 219/401
7,008,209 B2 * 3/2006 Iskra et al. ..... 425/182
7,027,887 B2 * 4/2006 Gaylo et al. ..... 700/117
7,059,144 B2 * 6/2006 Flynn et al. ..... 62/196.4
7,063,668 B2 * 6/2006 Cardelius et al. ..... 600/532
7,069,115 B1 * 6/2006 Woytowitz ..... 700/284
7,073,442 B2 * 7/2006 Fedor et al. ..... 101/480
7,076,373 B1 * 7/2006 Munsterhuis et al. ..... 702/51
7,087,326 B2 * 8/2006 Imamura et al. ..... 429/431
7,133,181 B2 11/2006 Greer
7,138,016 B2 * 11/2006 Reardon et al. ..... 118/313
7,181,319 B1 * 2/2007 Woytowtiz ..... 700/284
7,248,945 B2 * 7/2007 Woytowitz ..... 700/284
7,255,474 B2 * 8/2007 Cong et al. ..... 374/131
7,280,892 B2 * 10/2007 Bavel ..... 700/284
7,383,721 B2 * 6/2008 Parsons et al. ..... 73/46
7,398,139 B1 * 7/2008 Woytowitz ..... 700/284
7,451,941 B2 * 11/2008 Jackson ..... 239/423
7,457,716 B2 * 11/2008 Gebauer et al. ..... 702/114
7,478,540 B2 * 1/2009 Flynn et al. ..... 62/196.4
7,482,085 B2 * 1/2009 Roberts et al. ..... 429/34
7,624,514 B2 * 12/2009 Konabe et al. ..... 34/86
7,632,378 B2 * 12/2009 Sakurai et al. ..... 156/345.31
7,638,070 B2 * 12/2009 Johnson et al. ..... 252/373
2001/0049080 A1 * 12/2001 Asano et al. ..... 432/239
2002/0017055 A1 * 2/2002 Nalbandian et al. ..... 47/48.5
2002/0045410 A1 * 4/2002 Sakurai et al. ..... 451/57
2002/0084227 A1 * 7/2002 Sower ..... 210/739
2002/0092357 A1 * 7/2002 Theriault et al. ..... 73/760
2002/0121440 A1 * 9/2002 Morris ..... 204/421
2003/0097482 A1 * 5/2003 DeHart et al. ..... 709/253
2003/0106495 A1 * 6/2003 Asano et al. ..... 118/724
2003/0115893 A1 * 6/2003 Flynn et al. ..... 62/196.4
2003/0141188 A1 * 7/2003 Imamura et al. ..... 204/424
2003/0207655 A1 * 11/2003 Jackson ..... 451/38
2004/0003738 A1 * 1/2004 Imiolek et al. ..... 101/480
2004/0003741 A1 * 1/2004 Iskra et al. ..... 101/487
2004/0004303 A1 * 1/2004 Iskra ..... 264/109
2004/0004653 A1 * 1/2004 Pryor et al. ..... 347/106
2004/0005182 A1 * 1/2004 Gaylo et al. ..... 400/283
2004/0013571 A1 * 1/2004 Morris ..... 422/94
2004/0081746 A1 * 4/2004 Imafuku ..... 427/2.3
2004/0095237 A1 * 5/2004 Chen et al. ..... 340/506
2004/0118309 A1 * 6/2004 Fedor et al. ..... 101/480
2004/0131902 A1 * 7/2004 Frank et al. ..... 429/21
2004/0137823 A1 * 7/2004 Sakurai et al. ..... 451/5
2004/0142603 A1 * 7/2004 Walker ..... 439/701
2004/0210283 A1 * 10/2004 Rose et al. ..... 607/96
2004/0210289 A1 * 10/2004 Wang et al. ..... 607/116
2004/0211244 A1 * 10/2004 Cardelius et al. ..... 73/24.04
2004/0231667 A1 * 11/2004 Horton et al. ..... 128/202.13
2004/0254419 A1 * 12/2004 Wang et al. ..... 600/8
2004/0260470 A1 * 12/2004 Rast ..... 701/300
2004/0261632 A1 * 12/2004 Hansen et al. ..... 99/468
2005/0025797 A1 * 2/2005 Wang et al. ..... 424/422
2005/0056787 A1 * 3/2005 Cong et al. ..... 250/343
2005/0079132 A1 * 4/2005 Wang et al. ..... 424/1.11
2005/0081441 A1 * 4/2005 Mantovani ..... 47/67
2005/0087231 A1 * 4/2005 Sanders et al. ..... 137/489.5
2005/0107870 A1 * 5/2005 Wang et al. ..... 623/1.44
2005/0112418 A1 * 5/2005 Roberts et al. ..... 429/13
2005/0121536 A1 * 6/2005 Bavel ..... 239/69
2005/0133613 A1 * 6/2005 Mayer et al. ..... 239/63
2005/0159082 A1 * 7/2005 Sakurai et al. ..... 451/11
2005/0186305 A1 * 8/2005 Rosenberg et al. ..... 426/2
2005/0199842 A1 * 9/2005 Parsons et al. ..... 251/129.04
2005/0238506 A1 * 10/2005 Mescher et al. ..... 417/413.1
2005/0240807 A1 * 10/2005 Gebauer et al. ..... 714/6
2005/0257827 A1 * 11/2005 Gaudiana et al. ..... 136/263
2005/0268962 A1 * 12/2005 Gaudiana et al. ..... 136/255
2006/0076048 A1 * 4/2006 Gaudiana et al. ..... 136/246
2006/0130503 A1 * 6/2006 Flynn et al. ..... 62/196.4

2006/0144438 A1* 7/2006 Dresselhaus et al. ..... 137/78.3
2006/0161357 A1* 7/2006 Munsterhuis et al. ..... 702/51
2006/0168976 A1* 8/2006 Flynn et al. ..... 62/196.4
2006/0171847 A1* 8/2006 Morris ..... 422/83
2006/0174707 A1* 8/2006 Zhang ..... 73/592
2006/0202051 A1* 9/2006 Parsons et al. ..... 239/69
2006/0217846 A1* 9/2006 Woytowitz ..... 700/284
2006/0272704 A1* 12/2006 Fima ..... 137/12
2006/0272830 A1* 12/2006 Fima ..... 169/16
2006/0285091 A1* 12/2006 Parekh et al. ..... 355/30
2007/0010702 A1* 1/2007 Wang et al. ..... 600/8
2007/0012349 A1* 1/2007 Gaudiana et al. ..... 136/244
2007/0012556 A1* 1/2007 Lum et al. ..... 203/10
2007/0068791 A1* 3/2007 Thom et al. ..... 203/2
2007/0084713 A1* 4/2007 Deep et al. ..... 202/160
2007/0256984 A1* 11/2007 Benesi et al. ..... 210/741
2007/0266632 A1* 11/2007 Tsangaris et al. ..... 48/190
2007/0266634 A1* 11/2007 Tsangaris et al. ..... 48/197 R
2007/0284453 A1* 12/2007 Tsangaris et al. ..... 237/12
2007/0289216 A1* 12/2007 Tsangaris et al. ..... 48/197 R
2008/0063773 A1* 3/2008 Maguire ..... 426/523
2008/0147241 A1* 6/2008 Tsangaris et al. ..... 700/273
2008/0164006 A1* 7/2008 Karamanos ..... 165/67
2008/0209807 A1* 9/2008 Tsangaris et al. ..... 48/89
2008/0210089 A1* 9/2008 Tsangaris et al. ..... 95/90
2008/0263776 A1* 10/2008 O'Reagan et al. ..... 5/714
2009/0001193 A1* 1/2009 Parsons et al. ..... 239/69
2009/0056162 A1* 3/2009 McMahon et al. ..... 34/511
2009/0101490 A1* 4/2009 Thiers ..... 202/166
2009/0119990 A1* 5/2009 Johnson et al. ..... 48/61
2009/0119991 A1* 5/2009 Johnson et al. ..... 48/78
2009/0119992 A1* 5/2009 Johnson et al. ..... 48/89
2009/0119994 A1* 5/2009 Johnson et al. ..... 48/62 R
2009/0124963 A1* 5/2009 Hogard et al. ..... 604/30
2009/0126270 A1* 5/2009 Johnson et al. ..... 48/61
2009/0126276 A1* 5/2009 Johnson et al. ..... 48/62 R
2009/0130719 A1* 5/2009 Handique ..... 435/91.2
2009/0130745 A1* 5/2009 Williams et al. ..... 435/287.2
2009/0145985 A1* 6/2009 Mayer et al. ..... 239/542
2009/0179165 A1* 7/2009 Parsons et al. ..... 251/129.04
2009/0194026 A1* 8/2009 Burrows et al. ..... 118/719
2009/0221059 A1* 9/2009 Williams et al. ..... 435/287.2
2009/0231559 A1* 9/2009 Holmes ..... 355/30
2009/0265042 A1* 10/2009 Mollenkopf et al. ..... 700/298
2010/0000943 A1* 1/2010 Carson et al. ..... 210/638
2010/0024244 A1* 2/2010 Potter ..... 34/474
2010/0043143 A1* 2/2010 O'Reagan et al. ..... 5/421

* cited by examiner

APPARATUS AND METHOD FOR REDUCING A MOISTURE CONTENT OF AN AGRICULTURAL PRODUCT

BACKGROUND OF THE INVENTION

1. Field of the Invention

This invention relates to an apparatus and a method for reducing a moisture content of an agricultural product, particularly using moisture sensors and/or temperature sensors.

2. Discussion of Related Art

Conventional grain dryers seek to reduce a moisture content of grain before storage, such as for shelled corn, from about 25% moisture content at harvest to about 15% moisture content before storing the grain in a silo. Proper moisture content is important for storage because too much moisture leads to rot or spoilage, while too little moisture leads to poor taste or processing issues. Often grain dryers are controlled by periodic grab samples to check a dryer exit moisture content and then manually adjusting the unload rate from the dryer. This manual method leads to inconsistent results with some grain that is too wet and other grain that is too dry.

It is particularly difficult to dry grain with a uniform moisture content when the wet grain moisture content varies, such as from irrigated and non-irrigated sections of the same field. Even if the average moisture content of the dried grain is at a desired level, undesirable pockets of grain with a different moisture content can collect within the storage silo. Problem pockets can adversely affect the dried grain quality and/or monetary value.

There is an apparent need for an apparatus with a moisture sensor to control drying while reducing the moisture content of the agricultural product. There is also a need for a method that more consistently controls the moisture content of the dried agricultural product.

SUMMARY OF THE INVENTION

One object of this invention is to provide an improved control system for drying agricultural products using one or more moisture sensors. It is another object of this invention to provide a process for more consistently controlling outlet moisture content, particularly with varying inlet moisture content.

The above and other objects of this invention are accomplished with an apparatus for reducing the moisture content of agricultural products. The apparatus includes a dryer that passes the agricultural product through a drying chamber. Suitable dryers can be any configuration of a single zone or multiple zones and can operate with concurrent flow and/or countercurrent flow. The drying chamber has at least one inlet and at least one outlet.

The dryer has a suitable energy source which can be controlled, for example, throttled by an energy regulator. Combustion energy sources, such as natural gas, provide heat to remove moisture from the agricultural product. Agricultural products can include any suitable crop or other food product, such as, for example, wheat, rice, corn, rapeseed, canola, soybeans, barley, oats, rye, sorghum, millet and/or associated hybrids.

The apparatus of this invention can include at least one suitable flow regulator, such as a variable speed flow metering device. The flow regulator can vary an agricultural product flowrate or volume passing through the drying chamber.

At least one moisture sensor exposed to the agricultural product flowing through the drying chamber can obtain a moisture content at one or more locations, such as at any intermediate flow location, at an inlet and/or at an outlet. Any suitable moisture indicator or sensor known to those skilled in the art can be used, such as a planar capacitance meter.

In some embodiments, at least one temperature sensor exposed to the agricultural product flowing through the drying chamber obtains a temperature at one or more locations, such as at any intermediate flow location, at the inlet and/or at the outlet. Any suitable temperature indicator or sensor known by those skilled in the art, can be used, such as a protected thermistor.

A controller or other suitable calculating device operatively connects the sensors and the regulators, forming a control scheme. The controller can determine the product flowrate as a function of any detected inputs, variables and/or data signals, including a moisture content, a temperature and an energy input. The controller can determine the energy input as a function of any detected inputs, variables and/or data signals, including a moisture content, a temperature and a product flowrate. Desirably, the controller has programmed logic for calibrating the moisture sensor and the controller with respect to a sampled moisture content of the agricultural product. The controller can include a manual mode or a bypass mode, such as for use during start up, shutdown and/or troubleshooting.

Software or other suitable algorithms execute in the controller based on or as a function of the input signals, targets, set points and/or other parameters to produce suitable output signals. The controller also can have input devices, display devices, storage devices, communication devices and any other suitable components normally associated with a controller.

This invention also relates to a method of using the apparatus for reducing the moisture content of the agricultural product. The method can include measuring or obtaining the moisture content and/or the temperature, such as with a sensor exposed to the agricultural product flowing through the drying chamber.

The method further includes determining or calculating a product flowrate as a function of the moisture content, the temperature and/or the energy input. The product flowrate signal can be used to control or vary an agricultural product volumetric flowrate through the drying chamber.

In certain embodiments of this invention, the method can have additional moisture sensors, temperature sensors and/or other suitable sensor types. The controller can operate in manual mode during dryer initialization.

Optionally, the controller can determine or calculate the energy input as a function of the moisture content, the temperature and/or the product flowrate. The energy input signal varies the dryer energy source with the energy regulator.

Any suitable collection or combination of data or information can be displayed on and/or controlled from a screen, such as an inlet moisture content, an inlet temperature, an outlet moisture content, an outlet temperature, an input calibration moisture content, a product flowrate, a dryer plenum temperature and an amount of moisture removed.

BRIEF DESCRIPTION OF THE DRAWINGS

The above and other features and objects of this invention are better understood from the following detailed description taken in view of the drawings wherein.

DETAILED DESCRIPTION OF THE INVENTION

This invention, as shown in the FIGS. 1 to 5, is directed to apparatus 10 for reducing a moisture content of agricultural product 12. Agricultural product 12 is produced by farming methods and can be plant or other vegetative matter. Fruits, vegetables, other produce and natural fibers are examples of agricultural crops planted, cultivated, grown and/or raised. Organic and/or synthetic chemicals, pesticides, fungicides and fertilizers may be used in the growing process. Some grains and legumes are important monetary crops and provide staple food for the diet or consumption of humans as foodstuffs and/or animals as fodder.

Legumes can be beans, peas, lentils, alfalfa, peanuts, soybeans and any other suitable relatively high protein fruit. Grains or cereals can be the seeds of grasses and can comprise corn, rapeseed, canola, wheat, rice, barley, sorghum, millet, oats, rye, buckwheat, associated hybrids and/or any other suitable relatively high carbohydrate seed.

Moisture content of agricultural products 12 can affect taste, texture, cooking, processing, spoilage, mold growth, fungus growth and/or any other characteristic or quality related to a value of agricultural product 12. Typically, grains have a harvested moisture that unless reduced results in a degraded material or product when stored, such as in a grain elevator.

Figure 1:
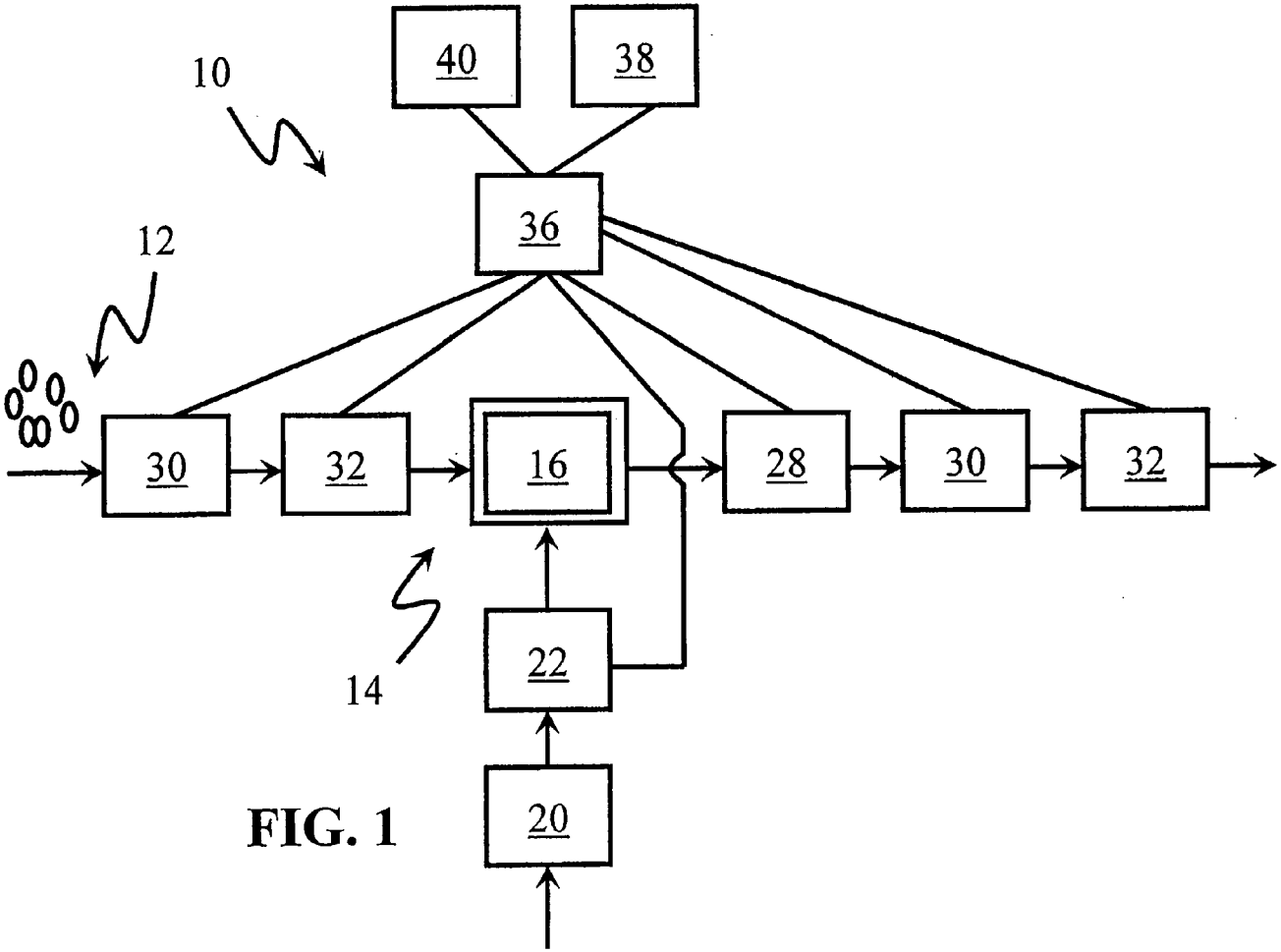
FIG. 1 is a schematic view of an apparatus for reducing a moisture content of an agricultural product, according to one embodiment of this invention.

As shown schematically in FIG. 1 and according to certain embodiments of this invention, apparatus 10 for reducing the moisture content of agricultural product 12 may comprise dryer 14, flow regulator 28, moisture sensor 30, controller 36 and optionally temperature sensor 32.

Dryer 14 can be any suitable device that reduces or removes moisture from agricultural product 12. Dryer 14 can be any suitable size with typical capacities ranging from a couple hundred bushels per hour to several thousand bushels per hour. Moisture typically is primarily of water but can also include solutions, emulsions and/or other liquids. Desirably, at least a portion of the moisture becomes a vapor or gas upon applying sufficient energy. Reducing a moisture content typically does not undesirably cook agricultural product 12 and does not undesirably neutralize enzymes.

Many variables or factors affect the operation of dryer 14, such as, for example, an ambient temperature, a relative humidity, a dew point, a temperature of agricultural product 12, a moisture content of agricultural product 12, a type of agricultural product 12, a maturity of agricultural product 12, a design of dryer 14, a configuration of dryer 14, a fuel of dryer 14 and/or any other state or condition impacting the moisture content of agricultural product 12. Typically, dryer 14 operates by applying psychometric and/or thermodynamic methods and/or principles.

Figure 2:
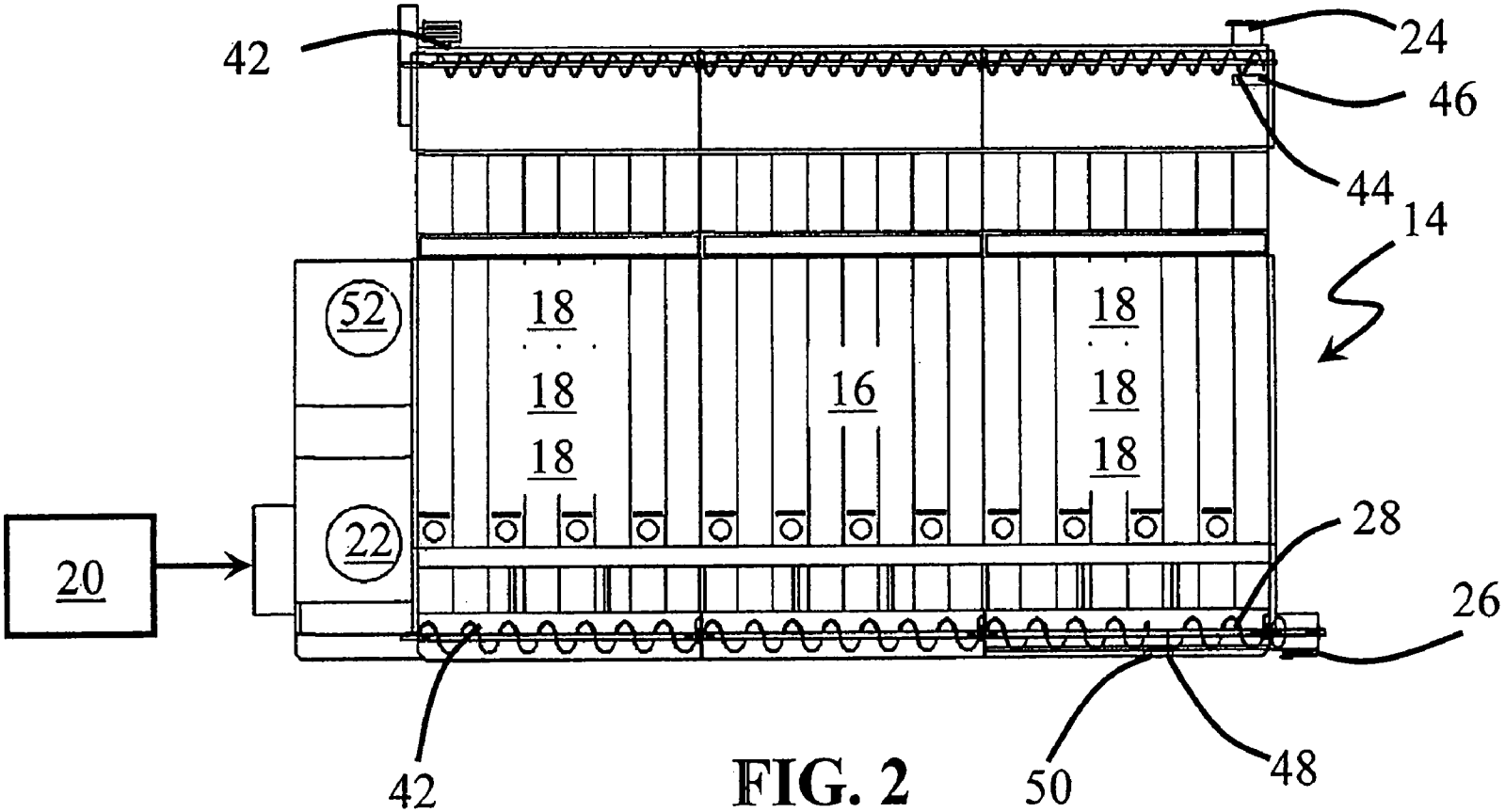
FIG. 2 is a schematic view of an agricultural product dryer, according to one embodiment of this invention.

In certain embodiments of this invention and as shown in FIG. 2, dryer 14 includes drying chamber 16 and energy source 20. Drying chamber 16 can be the space or area of dryer 14 for applying energy to agricultural product 12 and releasing or drawing moisture from agricultural product 12 as agricultural product 12 flows through drying chamber 16. The term flow refers to any suitable method for moving agricultural product 12, such as, for example, gravity, gravity assisted, mechanically, pneumatically and/or by any other transport mechanism. The term or phrase through with respect to drying chamber 16 refers to forming communication between energy source 20 and at least a portion of agricultural product 12. Typically, but not necessarily, drying chamber 16 comprises walls or another suitable structure to contain and/or insulate the drying process.

In certain other embodiments of this invention, drying chamber 16 comprises at least one inlet 24 receiving agricultural product 12 and at least one outlet 26 discharging agricultural product 12. Inlet 24 and outlet 26 can be a duct or a conduit and may include any suitable mechanical system to facilitate and/or control flow. Drying chamber 16 can be a column form having any suitable shape and/or dimension.

In other embodiments of this invention, drying chamber 16 includes a plurality of regions or multiple zones 18. Multiple zones 18 can be at different operating temperatures to contact the wettest agricultural product 12 with the hottest section of dryer 14 before agricultural product 12 moves to the next zone 18, such as with a cooler temperature. This concurrent configuration can improve dryer 14 efficiency and minimize possible damage to agricultural product 12 during drying. Alternately, dryer 14 can have a countercurrent configuration.

Dryer 14 can be any suitable configuration, such as a tower structure, a box design and/or a rotary drum. Dryer 14 can have a modular design to accommodate various design and/or operating requirements or needs. Dryer 14 can employ one or more fluidized beds or regions. Dryer 14 can operate in a batch mode or a discrete mode, a semi-continuous mode or an intermittent mode, and/or a continuous mode or a constant mode.

Energy source 20 can provide suitable forms of energy, including, for example, heat transfer by convection, conduction and/or radiation. Typical energy sources 20 include partial or complete combustion of natural gas, hydrogen, fuel oil, kerosene, gasoline, coal, peat, wood and/or any other suitable energy releasing material when burned with oxygen. Other energy sources 20 may include infrared generators, microwave generators, ultrasonic generators, x-ray generators, ultraviolet generators, chemical generators and/or any other suitable energy injecting devices. Desirably, energy source 20 is combined with dryer 14 and is in communication with energy regulator 22.

Energy regulator 22 can be any suitable device to control or throttle energy source 20. Typical energy regulators 22 may include control valves, rheostats, dampeners and/or any other suitable device for incrementally indexing an energy supply. The term incrementally indexing refers to discreetly and/or continuously increasing and/or decreasing a variable or object in a controlled manner. Desirably, energy regulator 22 is combined with dryer 14.

Energy regulator 22 can be operatively connected to controller 36 by sending and/or receiving one or more control signals, such as an analog signal or a digital electrical impulse or signal. Additional signal transmission methods include those associated with fiber optics, radio frequencies and/or any other suitable data couplings for inputs and/or outputs.

Dryer 14 may further comprise additional equipment, such as blower 52, plenums, thermocouples, combustion controls, emission monitoring systems, safety systems, interlock systems, control systems, recording systems, alarm systems, heat recovery systems, cooling coil systems, humidifying systems, dehumidifying systems, refrigeration systems and/or any other suitable auxiliary or ancillary devices to improve utility of dryer 14. Alternately, dryer 14 can function as a cooler to reduce a temperature of agricultural product 12.

Typically, cooling can occur by blowing ambient air across and/or through agricultural product 12.

Flow regulator 28 can be any suitable mechanism or device for incrementally or continuously indexing a volume of agricultural product 12. Desirably, flow regulator 28 is combined with dryer 14 and varies agricultural product 12 flowing through drying chamber 16. Flow regulator 28 can comprise rotary feeders, variable speed metering devices 42, screw augers, control valves and/or any other suitable metering or supply equipment for controlling agricultural product 12 flow. In some embodiments of this invention, flow regulator 28 is operatively connected to controller 36.

Moisture sensor 30 can be any suitable mechanism or device for obtaining or sensing a moisture content of agricultural product 12. Desirably, moisture sensor 30 is exposed to agricultural product 12 flowing through drying chamber 16 and operatively connected to controller 36. Moisture sensor 30 can sense or operate using visual, optical, ultraviolet, infrared, near infrared (NIR), laser, microwave, calorimetric, dialectic, impedance, conductance, capacitance, resistance technology and/or any other suitable technology to measure moisture content.

Moisture sensor 30 can physically contact or non-physically contact agricultural product 12. Moisture sensor 30 and/or any other suitable sensor can sense or detect, for example, media temperature and/or dielectric capacitance. Moisture sensor 30 can operate in a continuous monitoring mode or manner. Apparatus 10 may employ periodic or batch interval sampling protocols.

Figure 4:
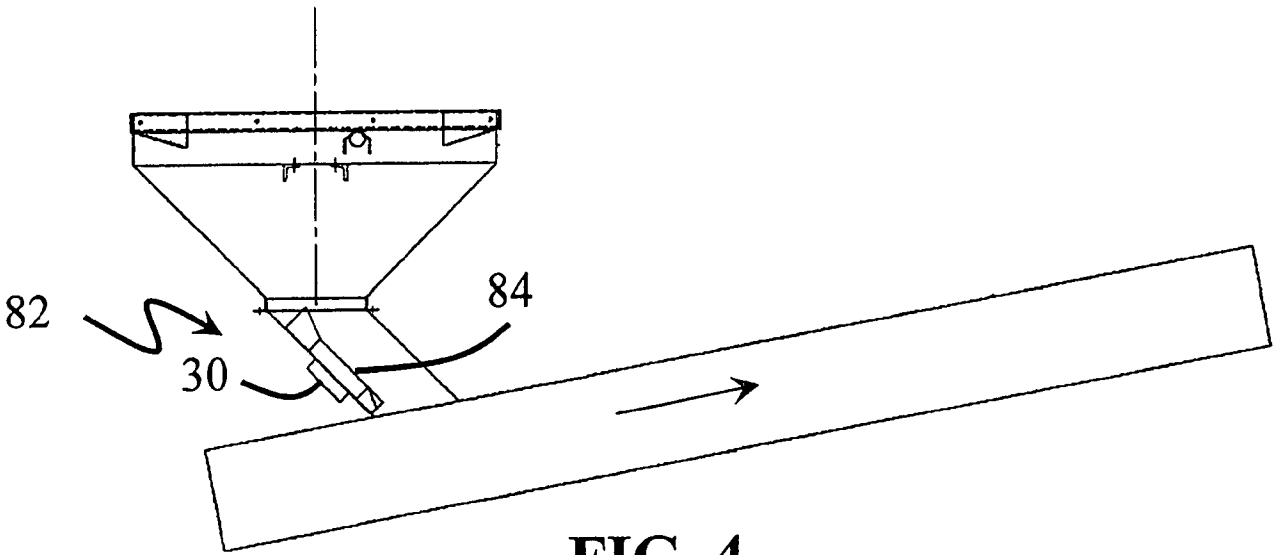
FIG. 4 is a side view of a mounting arrangement for a sensor, according to one embodiment of this invention.
Figure 5:
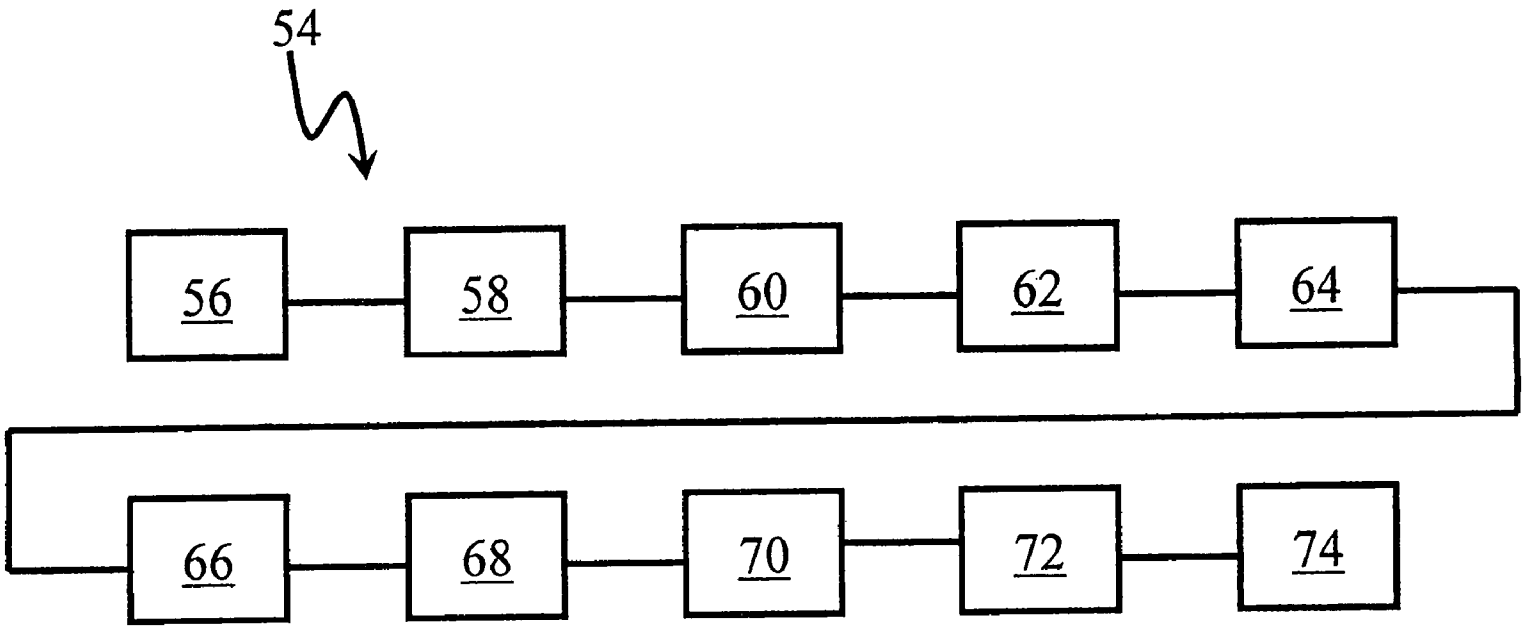
FIG. 5 is a schematic view of a method for reducing the moisture content of the agricultural product, according to one embodiment of this invention.

Slip stream and/or discrete sampling systems are also possible. According to certain embodiments of this invention and as shown in FIG. 4, sensor mount 82 can comprise flow conditioning apparatus 84 ensuring proper exposure or contact between moisture sensor 30 and at least a portion of agricultural product 12. Flow conditioning apparatus 84 is particularly suitable for tower dryers. In other embodiments of this invention, a positive grain flow arrangement is used to contact or expose agricultural product 12, such as on a screw conveyor.

According to certain embodiments of this invention, moisture sensor 30 is a planar capacitance meter. Moisture sensor 30 can mount in any suitable manner at any angle while exposed to agricultural product 12. Moisture sensor 30 can mount in any suitable manner with respect to dryer 14. Optional flow conditioning devices can improve exposure or contact between agricultural product 12 and moisture sensor 30.

Moisture sensor 30 can be exposed to agricultural product 12 in a location upstream with respect to drying chamber 16, resulting in a feed-forward control scheme and/or a location downstream with respect to drying chamber 16, resulting in a feedback control scheme. According to certain embodiments of this invention and as shown in FIG. 2, moisture sensor 44 is exposed to inlet 24 and moisture sensor 48 is exposed to outlet 26 resulting in a dual, hybrid and/or combination control scheme.

Moisture sensor 30 can comprise body 34 to protect internal components of moisture sensor 30, for example, from impacts of agricultural product 12 and/or any foreign debris, such as a rock picked up in the field during harvesting of agricultural product 12. According to certain embodiments of this invention, suitable materials for body 34 can be steel, anodized aluminum, alloy, nickel coated plate, ceramic plate and/or any other durable substance. A ceramic plate can comprise a face plate for a dialectic probe, such as a planar capacitance meter.

Moisture sensor 30 can have at least one circuit board with an added resistor network. Moisture sensor 30 can be powered by about 8 dc volts to about 12 dc volts, for example, at about 1 watt while producing an output of about 0 dc volts to about 5 dc volts over a range of about 0 percent moisture content to about 50 percent moisture content, depending upon particular characteristics of agricultural product 12.

Temperature sensor 32 can be any suitable mechanism or device for obtaining or sensing a temperature of agricultural product 12. Desirably, temperature sensor 32 is exposed to agricultural product 12 flowing through drying chamber 16 and is operatively connected to controller 36. Temperature sensor 32 can operate using optical, pyrometric, ultraviolet, infrared, laser, bimetallic union, thermocouple, temperature responsive resistor, thermistor technology and/or any other suitable technology to measure temperature and/or a change in temperature.

Temperature sensor 32 can physically contact or non-physically contact agricultural product 12. Typically, temperature sensor 32 operates in a continuous monitoring mode or manner. Apparatus 10 may employ periodic or batch interval sampling protocols. Slip stream or discrete sampling systems are also possible.

According to certain embodiments of this invention, temperature sensor 32 is a protected thermistor that can withstand agricultural product 12 and foreign debris. Temperature sensor 32 can mount in any suitable manner at any angle while exposed to agricultural product 12. Temperature sensor 32 can mount with respect to dryer 14 with flow conditioning devices to improve exposure or contact of agricultural product 12 to temperature sensor 32. Temperature sensor 32 can mount with respect to moisture sensor 30 for reliable operation and/or convenient maintenance.

According to certain embodiments of this invention, temperature sensor 32 comprises an embedded arrangement, such as under a face plate. In other embodiments of this invention, temperature sensor 32 comprises a visible arrangement protruding into a flowstream of agricultural product 12. Desirably, a stud, a bolt, a rod, a sheath and/or other suitable element is mounted upstream of temperature sensor 32 to protect from the blunt force of flowing agricultural product 12 and/or foreign debris.

Desirably, temperature sensor 32 can be powered by about 8 dc volts to about 12 dc volts, at about 1 watt, while producing a linear output of about 0 dc volts to about 5 dc volts, for example, over a linear range of about 50 degrees Fahrenheit to about 150 degrees Fahrenheit. Correspondingly higher temperature ranges can be used with respect to other parts of dryer 14, such as combustion monitoring temperature sensors.

Typically, temperature sensor 32 can be exposed to agricultural product 12 in a location upstream with respect to drying chamber 16 resulting a feed-forward control scheme and/or a location downstream with respect to drying chamber 16 resulting in a feedback control scheme. According to certain embodiments of this invention and as shown in FIG. 2, temperature sensor 46 is exposed to inlet 24 and temperature sensor 50 is exposed to outlet 26 resulting in a dual, hybrid and/or combination control scheme.

Figure 3:
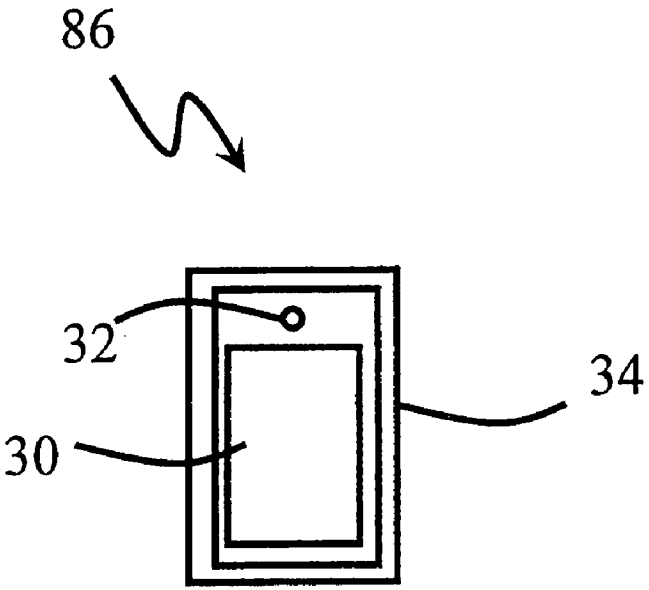
FIG. 3 is a top view of an integral sensor, according to one embodiment of this invention.

According to certain embodiments of this invention and as shown in FIG. 3, moisture sensor 30 and temperature sensor 32 integrally form sensor unit 86 sharing body 34, a circuit board and/or a power supply. Additional combinations of moisture sensor 30 and temperature sensor 32 are possible. Temperature sensor 32 can mount before and/or upstream of moisture sensor 30 with respect to a direction of flowing agricultural product 12.

Controller 36 can be any suitable device or mechanism for receiving input signals, processing the input signals according to one or more algorithms as a function of programmed parameters and/or variables, and sending or emitting corresponding control or output signals. In certain embodiments of this invention, controller 36 is an electronic digital microprocessor, such as a programmable logic controller (PLC) or a personal computer. Preferably, but not necessarily, controller 36 is a microprocessor using a shift registry accumulating and processing data to arrive at an accurate flow rate.

Controller 36 can further comprise a display, input device 38, screen 40, a touch screen, an interface device, a human machine interface (HMI), a networking device, a communication device, a keyboard, a mouse, a printer, a chart recorder, a data logger, a storage device, a security control, a software program, an application, a ladder logic, an operating system and/or any other suitable component or peripheral to assist, operate and/or compliment controller 36. Desirably, a human machine interface exists for operating apparatus 10 by a user.

In certain embodiments of this invention, controller 36 determines or calculates a product flowrate as a function of the moisture content and/or programmed logic or values. Product flowrate can represent the amount of agricultural product 12 flowing through drying chamber 16 for a given inlet moisture content and dryer 14 operating conditions, such as where a desired amount of moisture may be removed from agricultural product 12. The product flowrate can be a function of a temperature. In other embodiments of this invention, the product flowrate is a function of an inlet moisture content, an inlet temperature, an outlet moisture content, an outlet temperature and/or an amount or quantity of energy delivered to drying chamber 16. The product flowrate can relate to a signal applied to flow regulator 28 for adjusting the drying process to achieve the desired results.

The term or phrase as a function of refers to any suitable relationship, such as, for example, directly proportional, indirectly proportional, linear, exponential, logarithmic and/or any other mathematical and/or logical correlation between variable and/or fixed inputs and/or outputs. Suitable algorithms for controller 36 may include any appropriate tuning and/or dampening parameters or factors needed to optimize apparatus 10, such as a proportional-integral-derivative controller (PID).

According to certain embodiments of this invention, processor 36 determines or calculates an energy input. The energy input represents the amount of energy from energy source 20 supplied to drying chamber 16 for a given inlet moisture content and dryer 14 operating conditions where a desired amount of moisture will be removed from agricultural product 12. The energy input can also be a function of a temperature. In other embodiments of this invention, the energy input is a function of an inlet moisture content, an inlet temperature, an outlet moisture content, an outlet temperature and/or a product flowrate. Energy input can comprise a signal applied to energy regulator 22 for adjusting the process to achieve desired results.

Product flowrate can be a primary optimization variable in the algorithm or software of processor 36. Energy input can be a secondary optimization variable in the algorithm or software of processor 36. Primary and/or secondary variables can result in an efficient cascade or nested control arrangement with minimal hunting or seeking of set points. According to certain embodiments of this invention, the product flowrate first varies agricultural product 12 volume to or near the capacity limits of flow regulator 28 while maintaining the desired dried moisture content before changing the set point of the energy input and energy regulator 22. Combining different variables and/or functions can optimize control of apparatus 10.

Typically, controller 36 can receive and process at least one input signal, such as from a user, to calibrate or coordinate moisture sensor 30 and/or controller 36 with respect to a moisture content of agricultural product 12. User input values can be target values, such as obtained from a lab sample using a calibrated bench-top or lab moisture probe.

Apparatus 10 can comprise any desired level of duplication and/or redundancy, such as back-up moisture sensor 30 or a fail-safe two out of three voting arrangement for processors of controller 36.

This invention is further directed to method 54 of using apparatus 10. As shown schematically in FIG. 5 and according to certain embodiments of this invention, method 54 for reducing a moisture content of agricultural product 12 comprises obtaining moisture content 56, obtaining temperature 58, determining product flowrate 60, varying agricultural product volume 62 and drying 64 agricultural product 12.

Obtaining refers to sensing, reading, taking, scanning or any other suitable action for a sensor or probe to collect and/or process a measured or an inferred characteristic of agricultural product 12. Obtaining can occur at any suitable location or step of method 54. According to certain embodiments of this invention, obtaining occurs with respect to inlet 24 and/or outlet 26 of drying chamber 16.

Suitable agricultural products 12 for method 54 can be any agricultural product 12 previously discussed. According to certain embodiments of this invention, agricultural product 12 comprises wheat, rice, corn, shelled corn, maize, rapeseed, canola, soybeans, peas, coffee beans, mushrooms, lentils, barley, oats, rye, sorghum, millet, triticale, fonio, quinoa, associated hybrids and/or any combination of the above.

According to certain embodiments of this invention, method 54 comprises obtaining moisture content 56 with moisture sensor 30 exposed to agricultural product 12 flowing through drying chamber 16. Temperature 58 is obtained by exposing temperature sensor 32 to agricultural product 12 flowing through drying chamber 16. Product flowrate 60 in controller 36 can be determined as a function of the moisture content and/or the temperature. Determining product flowrate 60 can also be a function of additional moisture contents, additional temperatures and/or any other suitable parameters.

According to the same embodiment of this invention, volume 62 can be controlled based on the product flowrate with flow regulator 28. Agricultural product 12 can be dried in dryer 14 having agricultural product 12 flowing through drying chamber 16.

Method 54 can further include calibrating 70 with input controller 36 and/or moisture sensor 32 with respect to the moisture content of agricultural product 12. Typically, a user inputs this target value into apparatus 10 by suitable input device 38. Method 54 can include manual 72 or bypass operation, such as during start-up or dryer 14 initialization.

According to certain embodiments of this invention, method 54 comprises determining energy input 66 with controller 36 as a function of the moisture content, the temperature and/or the product flowrate. Energy source 20 can be varied based on the energy input with energy regulator 22.

Desirably, method 54 comprises displaying 74 information on screen 40, such as an inlet moisture content, an inlet temperature, an outlet moisture content, an outlet temperature, an input calibration moisture content, a product flowrate, a dryer plenum temperature and/or any other suitable relevant data for method 54.

Steps of method 54 are listed in the specification and shown in the figures for convenience but do not imply an order or sequence of steps or events. With respect to the control scheme, many of the steps can occur in a discrete and/or a continuous manner. Steps can be performed in a series and/or a parallel manner according to the needs of method 54 and/or apparatus 10. According to certain embodiments of this invention, several of the steps of method 54 occur substantially simultaneously.

The control scheme of apparatus 10 and method 54 produces dried agricultural product 12 having less variability or a smaller standard deviation of outlet moisture content compared to manual sampling and control methods.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed is:

1. An apparatus for reducing a moisture content of an agricultural product, the apparatus comprising:

a dryer passing the agricultural product through a drying chamber, the drying chamber having an inlet and an outlet;

a flow regulator varying a flow of the agricultural product through the drying chamber;

a first moisture sensor exposed to the agricultural product flowing through the inlet and obtaining an inlet moisture content;

a first temperature sensor exposed to the agricultural product flowing through the inlet and obtaining an inlet temperature;

a second moisture sensor exposed to the agricultural product flowing through the outlet and obtaining an outlet moisture content;

a second temperature sensor exposed to the agricultural product flowing through the outlet and obtaining an outlet temperature;

an energy regulator in combination with the dryer, the energy regulator varying an output of an energy source; and a controller operatively connected with the flow regulator, the first moisture sensor, the first temperature sensor, the second moisture sensor, the second temperature sensor and the energy regulator, the controller determining a product flowrate as a function of the inlet moisture content, the inlet temperature, the outlet moisture content, the outlet temperature and an energy input, and the controller determining the energy input as a function of the inlet moisture content, the inlet temperature, the outlet moisture content, the outlet temperature and the product flowrate.

2. The apparatus for reducing a moisture content of an agricultural product of claim 1, wherein the controller comprises a microprocessor using a shift registry accumulating and processing data to arrive at an accurate flow rate.

3. The apparatus for reducing a moisture content of an agricultural product of claim 1, wherein the first moisture sensor comprises a planar capacitance meter exposed to the agricultural product flowing through the drying chamber.

4. The apparatus for reducing a moisture content of an agricultural product of claim 1, wherein the first temperature sensor comprises a protected thermistor exposed to the agricultural product flowing through the drying chamber.

5. The apparatus for reducing a moisture content of an agricultural product of claim 1, further comprising an input calibrating at least one of the controller and the moisture sensor with respect to the moisture content of the agricultural product.

6. The apparatus for reducing a moisture content of an agricultural product of claim 1, wherein the dryer comprises multiple zones arranged in a concurrent configuration.

7. The apparatus for reducing a moisture content of an agricultural product of claim 1, wherein the flow regulator comprises a variable flow metering device feeding the agricultural product through the drying chamber.

8. The apparatus for reducing a moisture content of an agricultural product of claim 1, wherein at least one of the moisture sensor and the temperature sensor each is exposed to a dryer inlet.

9. The apparatus for reducing a moisture content of an agricultural product of claim 1, wherein at least one of the moisture sensor and the temperature sensor each is exposed to a dryer outlet.

10. The apparatus for reducing a moisture content of an agricultural product of claim 1, wherein the energy regulator supplies energy to the dryer, and the energy regulator is operatively connected to the controller.

11. The apparatus for reducing a moisture content of an agricultural product of claim 1, wherein the second moisture sensor comprises a planar capacitance meter exposed to the agricultural product flowing through the drying chamber.

12. The apparatus for reducing a moisture content of an agricultural product of claim 1, wherein the second temperature sensor comprises a protected thermistor exposed to the agricultural product flowing through the drying chamber.

* * * * *